US007594296B2

(12) United States Patent
Park

(10) Patent No.: US 7,594,296 B2
(45) Date of Patent: Sep. 29, 2009

(54) CONVERTIBLE VACUUM CLEANER

(75) Inventor: Sang Jun Park, Changwon-si (KR)

(73) Assignee: LG Electronics Inc., Seoul (KR)

( * ) Notice: Subject to any disclaimer, the term of this patent is extended or adjusted under 35 U.S.C. 154(b) by 736 days.

(21) Appl. No.: 11/100,538

(22) Filed: Apr. 7, 2005

(65) Prior Publication Data

US 2006/0130268 A1 Jun. 22, 2006

(30) Foreign Application Priority Data

Dec. 17, 2004 (KR) ..... 10-2004-0107648

(51) Int. Cl.
*A47L 9/00* (2006.01)

(52) U.S. Cl. ..... 15/328; 15/329; 15/331; 15/334

(58) Field of Classification Search ..... 15/331, 15/328, 334, 329; *A47L 9/00*
See application file for complete search history.

(56) References Cited

U.S. PATENT DOCUMENTS 2,758,667 A * 8/1956 Brace ..... 55/362
5,524,321 A * 6/1996 Weaver et al. ..... 15/329
6,094,775 A * 8/2000 Behmer ..... 15/329

* cited by examiner

*Primary Examiner*—David A Redding
(74) *Attorney, Agent, or Firm*—KED & Associates, LLP

(57) ABSTRACT

A convertible vacuum cleaner is provided. The vacuum cleaner includes a support base extending in a vertical direction, a main body selectively installed on the support base, a power generating unit disposed in the main body to generate a suction force, a suction nozzle unit that uses the suction force to draw in external air, a dust collection unit disposed in the main body to filter and collect dust and dirt contained in the external air, a flexible connection hose transmitting the suction force to the suction nozzle unit, a hose coupling portion formed on the main body to receive a first end of the connection hose, and a hook unit for supporting the main body on the support base.

17 Claims, 4 Drawing Sheets

CONVERTIBLE VACUUM CLEANER

BACKGROUND OF THE INVENTION

1. Field of the Invention

The present invention relates to a vacuum cleaner, and more particularly, to a convertible vacuum cleaner that can be operated in two modes, an upright type mode and a canister type mode. The present invention further relates to a convertible vacuum cleaner that can be stably and conveniently used.

2. Description of the Related Art

A vacuum cleaner is an electrically powered cleaning device that lifts dust and dirt by suction generated by a motor or a fan. A variety of vacuum cleaners such as a canister type, an upright type, a stick type, and a handy type are used according to places that are to be cleaned. Among the vacuum cleansers, the canister and upright type vacuum cleaners have been most widely used.

The canister type vacuum cleaner can be effectively used in the case where the user intends to clean a place such as stairs or a closet with an obstacle. That is, the canister type vacuum cleaner has a nozzle connected to a cleaner main body by a flexible hose and/or an extending tube, thereby lifting dust and dirt by suction. However, the canister type vacuum cleaner has a disadvantage in that the user draws the nozzle as well as the cleaner main body connected to the nozzle by the flexible hose. Therefore, it is difficult for the user to manipulate the vacuum cleaner. Particularly, when the user intends to clean a relatively wide area, the quick movement is deteriorated.

In the upright type vacuum cleaner, since a nozzle having a rotational brush is integrally coupled to a cleaner main body having a motor driving chamber and a dust collecting chamber, it can be effectively used when the user intends to clean a wide area such as a carpet or a floor. On the contrary, the upright type vacuum cleaner is not effective in cleaning the cleaning area with an obstacle such as steps and furniture.

Considering the above facts, a convertible vacuum cleaner having the advantages of both the canister and upright type vacuum cleaners while solving the disadvantages has been developed. The convertible vacuum cleaner is converted into one of canister and upright type modes according to the cleaning area. Such a convertible vacuum cleaner is disclosed in U.S. Pat. No. 5,524,321.

The convertible vacuum cleaner has, however, a couple of problems as follows:

1. Since the structure is complicated, it is difficult for the user to manipulate.

2. Since a lower end of the cleaner main body is designed to be fixed on a support base, the cleaner main body may be damaged by being dropped from the support base when outer impact is transmitted to the cleaner main body.

3. Many parts are required to make the cleaner, thereby increasing the manufacturing costs.

SUMMARY OF THE INVENTION

Accordingly, the present invention is directed to a convertible vacuum cleaner that substantially obviates one or more problems due to limitations and disadvantages of the related art.

An object of the present invention is to provide a convertible vacuum cleaner having a cleaner main body that can be securely detachably supported on a support base.

Another object of the present invention is to provide a convertible vacuum cleaner having a main body supporting assembly that is designed in a simple structure to securely support the cleaner main body on a support base so that the cleaner main body is not moved even by outer impact.

A still another object of the present invention is to provide a convertible vacuum cleaner in which a power connection between a cleaner main body and a support base can be reliably realized.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, there is provided a convertible vacuum cleaner comprising: a support base extending in a vertical direction; a main body selectively installed on the support base; a power generating unit disposed in the main body to generate outer air sucking force; a suction nozzle unit sucking outer air using the sucking force transmitted from the main body; a dust collection unit disposed in the main body to filter and collect dust and dirt contained in the outer air sucked by the sucking force; a flexible connection hose transmitting the sucking force to the suction nozzle body; a hose coupling portion to which a first end of the connection hose is coupled, the hose coupling portion being formed on the main body; and a hook unit for supporting the main body on the support base.

According to another aspect of the present invention, there is provided a convertible vacuum cleaner comprising: a support base extending in a vertical direction; a main body selectively installed on the support base; a power generating unit disposed in the main body to generate outer air sucking force; a suction nozzle unit sucking outer air using the sucking force transmitted from the main body; a dust collection unit disposed in the main body to filter and collect dust and dirt contained in the outer air sucked by the sucking force; a flexible connection hose transmitting the sucking force to the suction nozzle body; a hose coupling portion to which a first end of the connection hose is coupled, the hose coupling portion being formed on the main body; and a first hook member formed on a rear surface of the main body; and a second hook member formed on the support base, the second hook member being associated with the first hook member so as to support the main body on the support base.

According to a still another aspect of the present invention, there is provided a convertible vacuum cleaner comprising: a support base provided at a top with a handle; a main body selectively installed on the support base; a power generating unit disposed in the main body to generate outer air sucking force; a suction nozzle unit sucking outer air using the sucking force transmitted from the main body; a dust collection unit disposed in the main body to filter and collect dust and dirt contained in the outer air sucked by the sucking force; a flexible connection hose transmitting the sucking force to the suction nozzle body; a hose coupling portion to which a first end of the connection hose is coupled, the hose coupling portion being formed on the main body; a direction roller formed on a rear surface of the main body; and a receiving groove formed on the support base to receive the directional roller of the main body when the main body is installed on the support base.

According to a still yet another aspect of the present invention, there is provided a convertible vacuum cleaner comprising: a support base used when the vacuum cleaner is used as an upright type; a main body selectively installed on a front surface of the support base; a power generating unit disposed in the main body to generate outer air sucking force; a suction nozzle unit sucking outer air using the sucking force transmitted from the main body; a dust collection unit disposed in the main body to filter and collect dust and dirt contained in the outer air sucked by the sucking force; a flexible connection hose transmitting the sucking force to the suction nozzle body; a hose coupling portion to which a first end of the connection hose is coupled, the hose coupling portion being formed on the main body; a first handle formed on a top of the main body used when releasing the main body from the support base; and a second handle formed on a front surface of the main body, the second handle being used when the vacuum cleaner is used as a canister type.

According to the present invention, since the main body is designed to be installed or separated on or from the support base by a simple structure, the installation and separation of the main body on and from the support base can be easily realized and the installing location of the main body on the support base can be securely supported.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
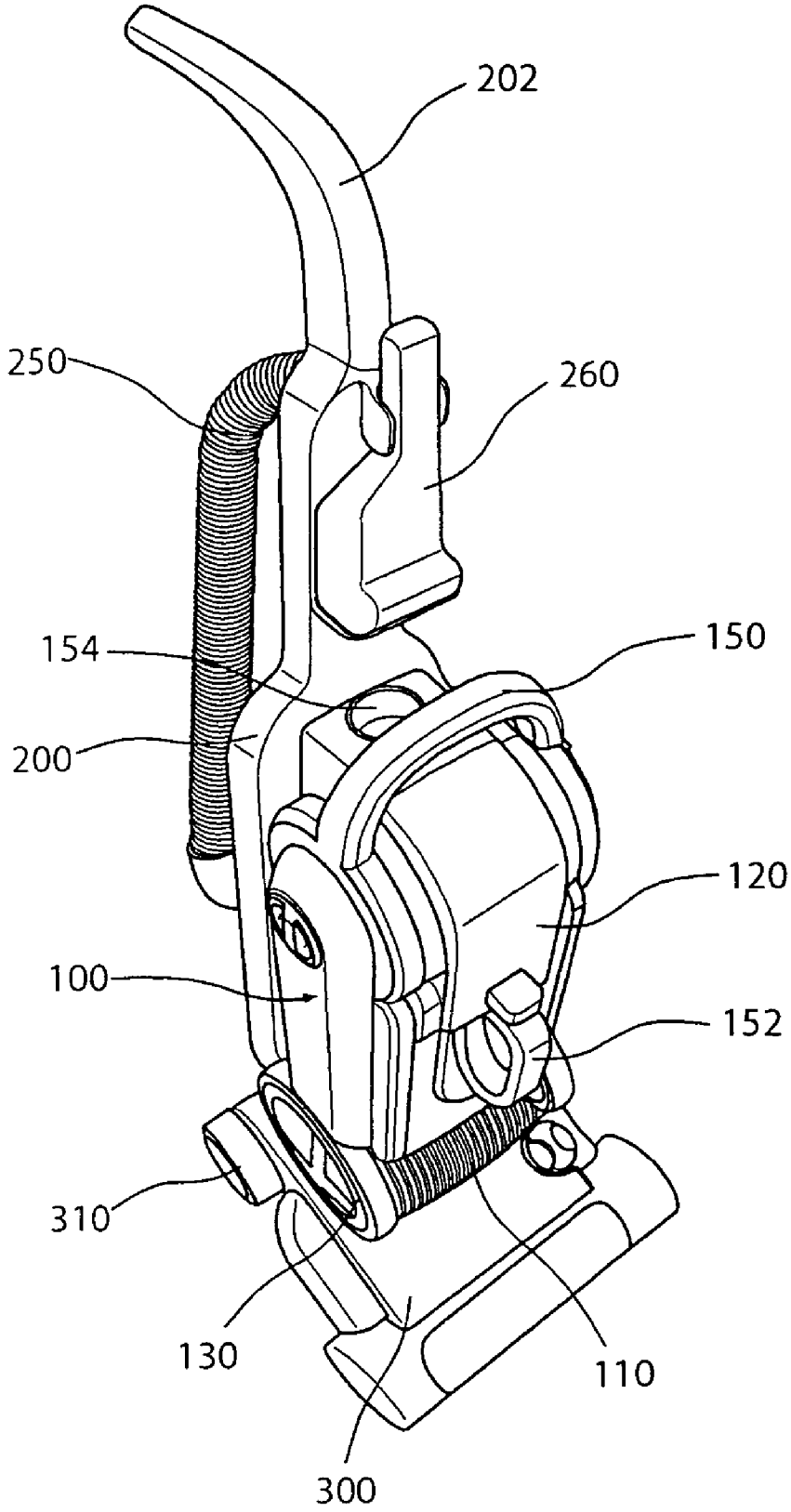
FIG. 1 is a perspective view of a convertible vacuum cleaner according to an embodiment of the present invention.
Figure 2:
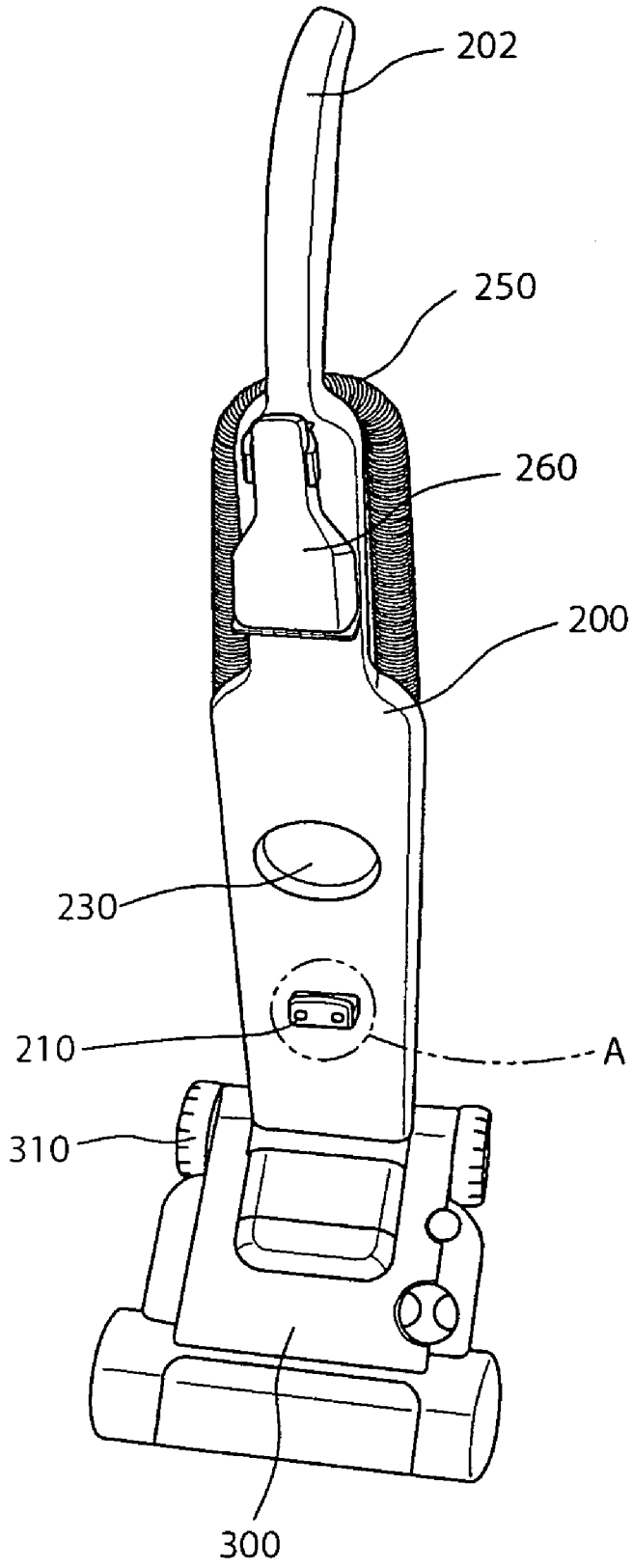
FIG. 2 is a front perspective view of a support base of a convertible vacuum cleaner according to an embodiment of the present invention.
Figure 3:
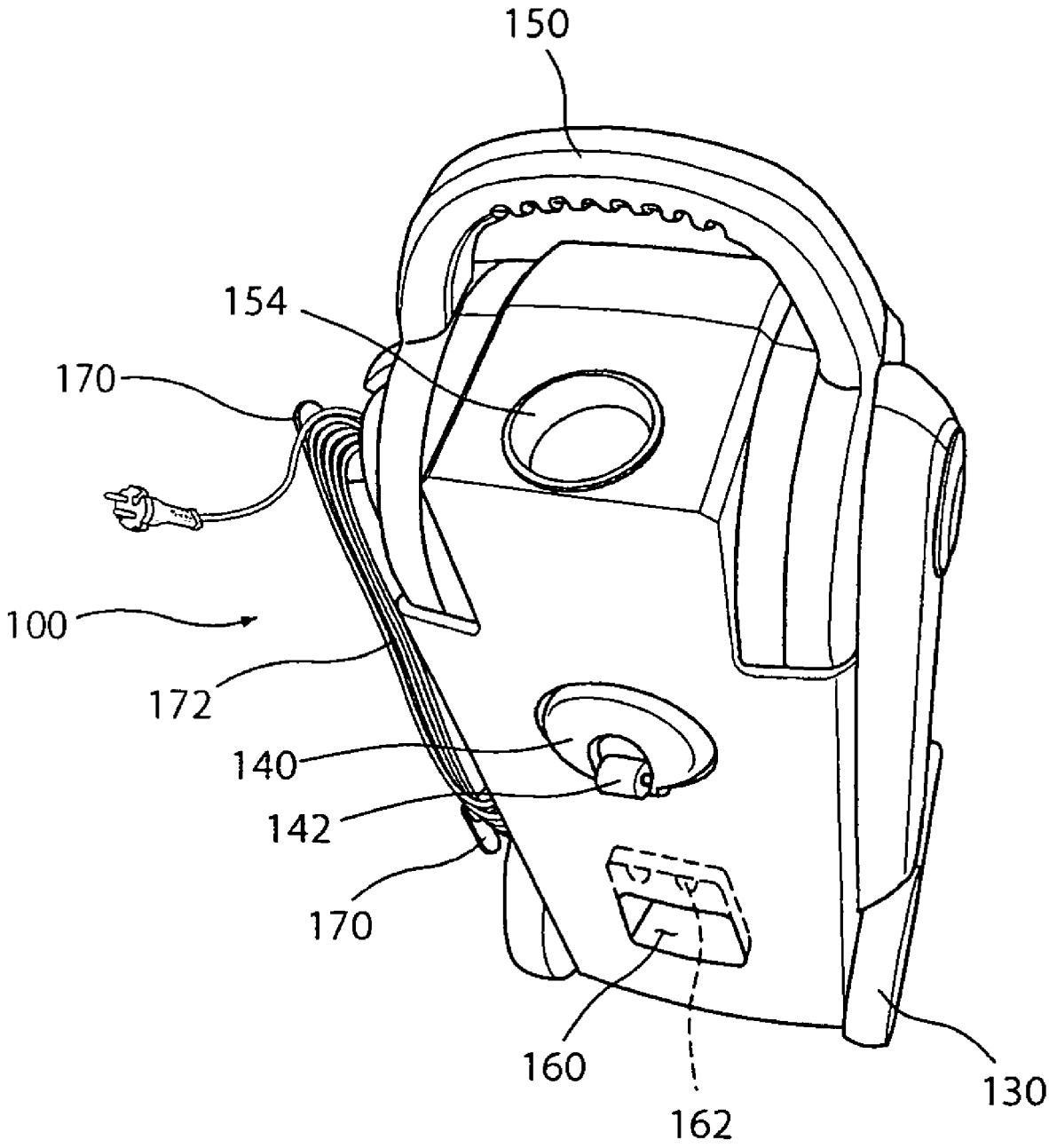
FIG. 3 is a rear perspective view of a cleaner main body of a convertible vacuum cleaner according to an embodiment of the present invention.

FIG. 1 is a perspective view of a convertible vacuum cleaner according to an embodiment of the present invention, FIG. 2 is a front perspective view of a support base of a convertible vacuum cleaner according to an embodiment of the present invention, and FIG. 3 is a rear perspective view of a cleaner main body of a convertible vacuum cleaner according to an embodiment of the present invention.

Referring to FIGS. 1 to 3, the inventive convertible vacuum cleaner includes a main body 100 housing a plurality of components such as a motor and a fan and collecting dust and dirt, a support base 200 supporting the cleaner main body 100, and a suction nozzle unit 300 guiding air containing the dust and dirt to the main body 100.

The support base 200 is designed to fix a mounting portion of the main body 100 when the main body 100 is disposed thereon. That is, the main body 100 is selectively hooked and supported on a front surface of the support base 200. An upper portion of the support base 200 is further projected upward and rounded rearward to define a handle 202.

In a state where the main body 100 is installed on the support base 200, the user grasps the handle 202 and moves the vacuum cleaner. At this point, the vacuum cleaner is operated as an upright type vacuum cleaner.

In a state where the main body 100 is not installed on the support base 200, only the main body 100 is operated so that the vacuum cleaner is operated as a canister type vacuum cleaner. That is, all of the components required to operate the vacuum cleaner are disposed in the main body 100 so that it is possible that only the main body 100 can be operated.

The main body 100 and the support 200 will be described hereinafter in more detail.

The main body 100 is designed to be detachable from the support base 200. In a state where the main body 100 is detached from the support base 200, the main body 100 is independently used so as to function as the canister type vacuum cleaner. When the main body 100 is fixed on the support base 200, the main body 100 is used together with the support base 200 so as to function as the upright type vacuum cleaner. That is, the vacuum cleaner of the present invention can be used as a convertible vacuum cleaner.

Formed under the main body 100 is a power generating unit 110 generating sucking force. Formed above the power generation unit 110 is a dust collection unit 120 collecting dust and dirt contained in the air. The power generation unit 110 includes a motor (not shown) that generates rotational power when electric power is applied. The sucking force for lifting dust and dirt is generated by the fan rotating by rotational power generated by the motor. The dust collection unit 120 includes a filter for filtering the dust and dirt contained in the air and a dust box collecting the dust and dirt filtered by the filter. A cyclone-type collection filter or a porous filter may be used as the filter.

In addition, a pair of main body wheels 130 is installed on both side ends of the main body 100. The main body wheels 130 allow the main body 100 to move frontward and rearward. When the main body 100 is detached from the support base 200 to independently move, the main body wheels 130 contact the floor and rotate for the effective movement of the main body 100.

A rotational body 140 is rotatably installed on a bottom center of the main body 100. The rotational body 140 is formed in a circular shape.

A roller 142 is installed on the rotational body 140. As the rotation body 142 is designed to rotate, the roller 142 rotates in a multi-direction. Therefore, when the main body 100 is detached from the support base 200 to be used as the canister type vacuum cleaner, the rotational body 140 and the roller 142 allow the main body 100 to be movable in the multi-direction.

When the main body 100 is detached from the support base 200 to be used as the canister type vacuum cleaner, the rear surface of the main body 100 closely faces the floor. At this point, the roller 142 rolls in a state where it contacts the floor. Therefore, the main body 100 can effectively change its advancing direction. When the main body 100 moves, the weight of the main body 100 is supported by the main body wheels 130 allowing the main body 100 to effectively move.

The roller 142 is designed to be partly projected from the rear surface of the main body 100. When the main body is installed on the support base 200, the projected roller 142 is received in a receiving groove 230 formed on the front surface of the support base 200. Therefore, the roller 142 can be located on an accurate location without being interfered by the support base 200 when the main body 100 is installed on the support base 200.

A top handle 150 is formed on a top of the main body 10. The top handle 150 is projected from the top of the main body so that the user can easily grasp the same. Accordingly, the user can manipulate the main body 100 and detach the main body 100 from the support base 100 after grasping the top handle 150.

Describing in more detail, when it is intended to detach the main body 100 from the support base 200, the user grasps the top handle 150 and lifts the main body 100 upward to detach the main body 100 from the support base 200. The top handle 150 also functions to conveniently move the main body 100 when it is intended to clean the floor using only the main body 100.

A front handle 152 is further formed on a front surface of the main body 100. The front handle 152 is projected above from the front surface of the main body 100 so that the user can easily grasp the same. Therefore, when the user intends to move the main body 100 after removing the main body 100 from the support base 200, the user grasps the front handle 152 to move the main body 100.

The main body 100 is provided at the top with a hose coupling portion 154 to which one end of a connection hose 250 is coupled. Outer air is introduced into the main body 100 through the hose coupling portion 154. Therefore, the hose coupling portion 154 is formed in a circular shape corresponding to the one end of the connection hose 250.

A coupling groove 160 is formed on the rear surface of the main body 100. The coupling groove 160 is defined by depressing a portion of the rear surface of the main body 100 to guide the install of the main body 100 on the support base 200 and fixing the location of the support base 200.

Figure 5:
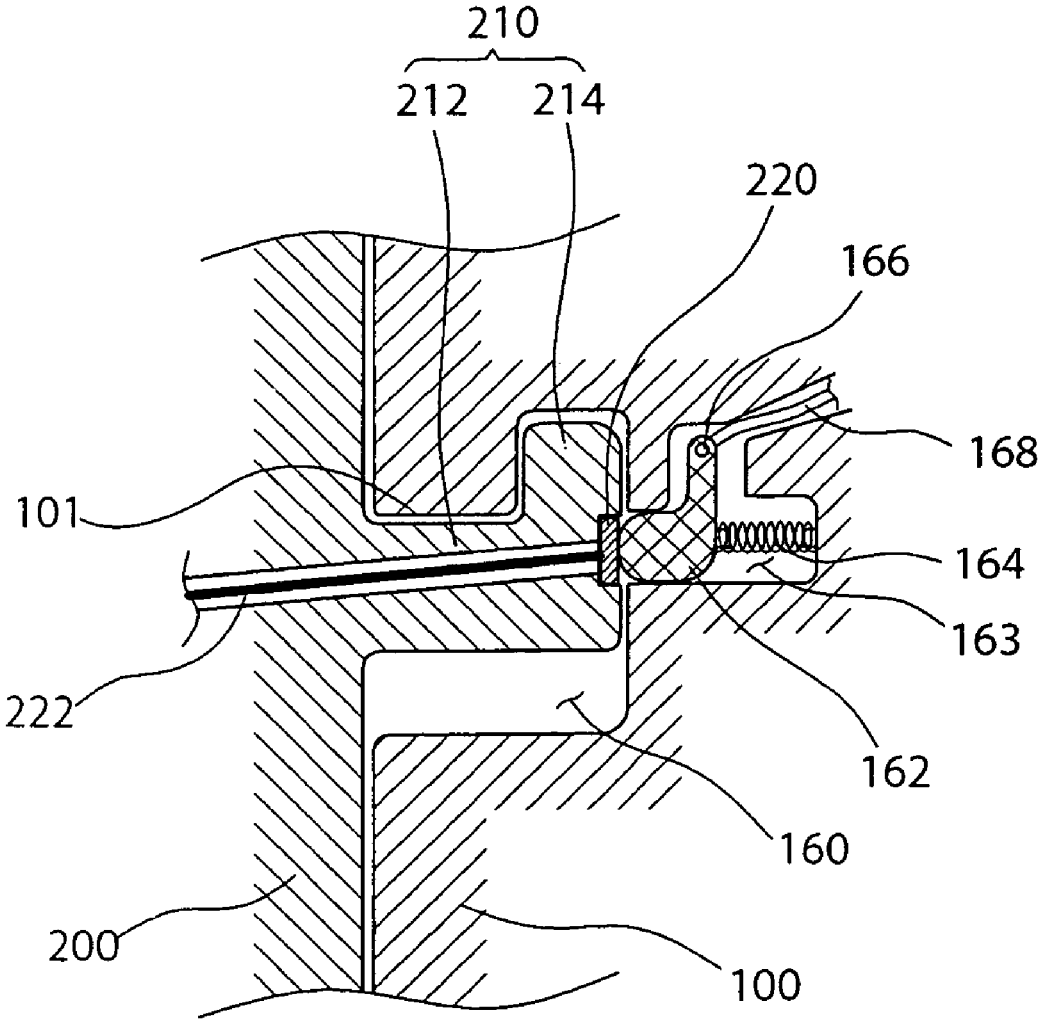
FIG. 5 is a sectional view of a coupling portion of a cleaner main body and a support base according to an embodiment of the present invention.

That is, the coupling groove 160 is depressed inward from the rear surface of the main body 100 and is further depressed upward as shown in FIG. 5. That is, the coupling groove 160 is formed in a ]-shape. As a result, a front end of the coupling groove 160 functions as a hook step 101 (see FIG. 5). As a result, a hook projection 210 is hooked in the coupling groove 160.

A first terminal 162 is located in the coupling groove 160. The first terminal 162 functions to connect outer electric power applied to the main body 100 to the support base 200. The electric power applied to the main body 100 is transmitted to the suction nozzle unit 300 to rotate, for example, an agitator of the suction nozzle.

A projection receiving chamber 163 is formed inwardly from the hook groove 160 and the first terminal 162 is received in the projection receiving chamber 163. An internal structure of the hook groove 160 is illustrated in detail in FIGS. 4 and 5.

A cord fixing member 170 is formed on a side surface of the main body 100, being projected from the side surface of the main body 100. That is, the cord fixing member 170 is formed of a pair of projections that are symmetrically disposed. A power cord transmitting outer power to the main body 100 is wound around the cord fixing member 170 when the cleaner is not used.

The front surface of the support base 200 is flat to correspond to the rear surface of the main body 100. The hook projection 210 to be inserted into the hook groove 160 is formed on the front surface of the support base 200. By inserting the hook projection 210 into the hook groove 160, the main body 100 is securely fixed on the support base 200.

That is, the hook projection 210 includes a horizontal section 212 projected frontward from the front surface of the support base 200 and a vertical section 214 extending upward from an extreme end of the horizontal section 212.

As described above, the hook projection 210 is formed in the □-shape and selectively inserted in the hook groove 160 (see FIG. 5). When the hook projection 210 is received in the hook groove 160, the vertical section 214 is hooked on the hook step 101 so that the main body 100 cannot be inadvertently separated from the support base 200.

A second terminal 220 is formed on the hook projection 210. The second terminal 220 contacts the first terminal 162 so as to transmit power from the main body 100 to the suction nozzle unit 300. Therefore, it is preferable that the first and second terminals 162 and 220 are formed of high conductive material.

Describing in more detail., the second terminal 220 is formed in front of the vertical section 214 of the hook projection 210. The second terminal 220 is formed in a circular shape corresponding to an outer surface of the first terminal 162 to selectively contact a proximal end of the first terminal 162. Connected to the second terminal 220 is a power transmission wire 222. The power transmission wire 222 is designed to transmit the power transmitted from the main body 100 to the second terminal 220 to the agitator (not shown) of the suction nozzle unit 300. In the case where there are power consumption parts in the support base 200 and the suction nozzle unit 300, the agitator may be operated by the power transmitted from the terminals 162 and 220.

The connection hose 250 is kept in a state where it is suspended on the support base 200. That is, the connection hose 250 is formed of a flexible material and hooked on a rear-upper end of the support base 200. A first end of the connection hose 250 is fitted on the hose coupling portion 154 of the main body 100. In the drawing, although the connection hose 250 is separated from the coupling portion 154, the connection hose 250 will be coupled to the hose coupling portion 154 in an actual use. For example, when the cleaner is used as the canister type vacuum cleaner, the first end of the connection hose 250 is coupled to the main body 100 and a second end is coupled to a mini nozzle 260. When the cleaner is used as the upright type vacuum cleaner, the first end of the connection hose 250 is connected to the main body 100 and the second end is connected to the suction nozzle unit 300. When the cleaner is not used, the connection hose 250 is suspended on the support base 200. Furthermore, even when the cleaner is used as the upright type vacuum cleaner, the first end of the connection hose 250 is connected to the main body 100 and the second end may be coupled to the mini nozzle 260, thereby varying the cleaning method.

The mini nozzle 260 is provided on a front-upper portion of the support base 200. The mini nozzle 260 is selectively installed on the second end of the connection hose 250 to be used to lift dust located on a corner or a narrow space.

The suction nozzle unit 300 is pivotally installed on a lower end of the support base 200 to guide the air suction containing the dust and dirt. The suction nozzle unit 300 moves in a state where it closely faces the floor to lift the dust and dirt by suction. Accordingly, a pair nozzle wheels 310 are provided on both rear-side ends of the suction nozzle unit 300 to allow the user to effectively move the cleaner. The suction nozzle unit 300 is provided at a front end with a suction hole for introducing the air containing the dust and dirt. The suction nozzle unit 300 is further provided at an inner bottom with the agitator for separating the dust and dirt from the floor.

The operation of the above-described convertible vacuum cleaner will be described hereinafter.

A case where the convertible vacuum cleaner is used as the upright type vacuum cleaner will be first described hereinafter.

In an upright type cleaning mode, the main body 100 is hooked on the support base 200. In this state, the user grasps the support handle 202 and inclines the support base 200 rearward by a predetermined angle performs the cleaning operation while moving the cleaner. That is, in a state where the main body 100 is mounted on the support base 200, when the user inclines the support handle 202 rearward, the support base 200 pivots with reference to its lower end. Therefore, in a state where the suction nozzle 300 contacts the floor, the support base 200 and the main body 100 are inclined rearward together. In this state, the user performs the cleaning work while moving the cleaner.

Meanwhile, the outer power is applied to the main body 100 through the power cord 172, and the applied power is transmitted to a motor (not shown) of the main body 100. When the motor is driven, sucking force is generated by the fan to lift the dust and dirt.

In addition, the power applied to the main body 100 is transmitted to the suction nozzle unit 300 through the terminals formed in the main body 100 and the support base 200. That is, the outer power applied to the main body 100 is transmitted to the first terminal 162 through the power supply line 168 and is then finally transmitted to the agitator (not shown) of the suction nozzle unit 300 by the contact between the first and second terminals 162 and 220. The agitator applied with the power rotates to separate the dust and dirt from the floor and the separated dust and dirt are introduced into the suction nozzle unit 300 through the suction hole (not shown). The agitator is designed not to rotate by the motor but to forcedly rotate by flow of the introducing air. When the agitator is designed to forcedly rotate, no electric power is required.

The dust and dirt contained in the air introduced through the suction nozzle unit 300 are directed to the main body 100 through the connection hose 250 and then collected in a dust collection unit 120 after being filtered. When a predetermined amount of the dust and dirt is accumulated in the dust collection unit 120, the user empties the dust collection unit 120.

A case where the convertible vacuum cleaner is used as the canister type vacuum cleaner will be described hereinafter.

In a canister type mode, the main body 100 is first separated from the support base 200. That is, in a state where the main body 100 is installed on the support base 200, the user grasps the top handle 150 and lifts the main body 100 so that the vertical section 214 of the hook projection 210 can be released from the hook groove 160. At this point, the engaging state between the hook step 101 and the vertical section 214 is released. In this state, when the user pushes the main body 100 forward, the main body 100 is separated from the support base 200.

In this state, the user can perform the cleaning work in a state where he/she grasps the front handle 152 or he/she disposes the main body 100 on the floor. When the main body 100 is disposed on the floor, the main body wheels 130 and the roller 142 contact the floor. The main body wheels 130 function to move the main body 100 frontward or rearward while the roller 142 functions to move the main body 100 in the multi-direction.

As described above, the outer power is applied to the main body 100 through the power cord 172 and the motor and fan disposed in the main body are operated by the applied power, thereby generating sucking force of the vacuum cleaner.

The mini nozzle 260 may be connected to the connection hose 250 or other accessories such as a crevice tool may be connected to the connection hose 250 to effectively lift the dust and dirt located on the corner or the narrow space.

When the cleaning work is finished, the main body 100 is kept in a state where it is installed on the support base 200. At this point, as illustrated in detail in FIG. 5, the hook projection 210 is inserted in the hook groove 160 of the main body 100 to prevent the main body 100 from being inadvertently separated from the support base 200.

A fixing structure of the main body 100 on the support base 200 will be described in more detail hereinafter.

Figure 4:
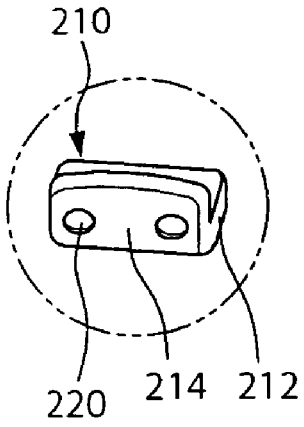
FIG. 4 is an enlarged view of a circled portion A of FIG. 2.

FIG. 4 shows an enlarged view of a circled portion A of FIG. 2 and FIG. 5 shows a section view of a coupled portion of the main body and the support base.

Referring to FIGS. 4 and 5, as described above, the hook projection 210 includes the horizontal section 212 projected frontward from the front surface of the support base 200 and the vertical section 214 extending upward from an extreme end of the horizontal section 212. The vertical section 214 is provided at an end with the second terminal 220 to receive the power from the main body 100.

The hook projection 210 is hooked in the hook groove 160 formed on the main body 100. The first terminal 162 contacting the second terminal 220 is provided in the hook groove 210. In order for the first terminal 162 to accurately contact the second terminal 220, movement is performed in a predetermined pattern. The structure and function of the first terminal 162 will be described in more detail hereinafter.

The first terminal 162 is bent in a predetermined shape and received in the terminal receiving chamber 163. The first terminal 162 is biased by an elastic spring 164 toward the second terminal 220. The elastic spring 164 is preferably formed of a compression spring. The first terminal 162 is biased by the elastic spring 164 so that it can contact the second terminal 220.

In addition, the first terminal 162 is formed in a □-shape, having an upper end pivotally supported on a binge shaft 166. Accordingly, the first terminal 162 pivots around the hinge shaft 166 by the elastic force of the elastic spring 164 such that a first end of the first terminal 162 can be projected into the hook groove 160 to contact the second terminal 220, thereby transmitting the electric power. A second end of the first terminal 162 is connected to the power supply line 168 to transmit the electric power applied to the main body to the suction nozzle body 300 or the power consumption parts in the support base 200.

The present invention is not limited to the above-described structure. Those skilled in the art can variously modify and vary the structure according to the concepts of the present invention.

For example, the coupling structure defined by the hook projection 210 and the hook groove 160 may be varied within the scope of the concept of the present invention as far as it can easily realize the mounting of the main body 100 on the front surface of the support base 200. For example, the hook projection 210 may be formed on the main body 100 while the hook groove 160 is formed on the support base 200.

In addition, the power transmission structure can be varied. For example, the second terminal may be formed in the hook groove 160 while the first terminal 162 is provide in the first terminal 162 biased by the elastic spring is provided in the hook projection 210.

According to the present invention, the cleaner main body is designed to be hooked on the front surface of the support base. That is, by the hooking operation, the hook projection and the hook groove are associated with each other to support the main body on the support base. As described above, since the main body is supported on the support base by the simple hooking operation, no special supporting member for supporting the bottom of the main body is required, thereby reducing the manufacturing costs.

In addition, the power transmission from the main body to the support base can be simply realized by the terminals provided in the coupling groove and the coupling projection. As a result, the power applied to the main body can be transmitted to the suction nozzle unit by the simple structure.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. A convertible vacuum cleaner, comprising:

a support base extending in a vertical direction;

a main body selectively installed on the support base;

a pair of main body wheels provided on opposite side ends of the main body;

a power generator provided in the main body to generate an external air suction force;

a suction nozzle that draws in external air using the suction force transmitted from the main body by the power generator;

a dust collection assembly provided in the main body to filter and collect dust and dirt from the external air drawn in by the suction force;

a flexible connection hose transmitting the suction force from the main body to the suction nozzle body;

a hose coupling portion to which a first end of the connection hose is coupled, the hose coupling portion being formed on the main body; and a hook assembly that supports the main body on the support base, wherein the hook assembly is provided with a pair of terminals for transmitting electric power.

2. The convertible vacuum cleaner according to claim 1, wherein the hook assembly is formed on facing surfaces of the support base and the main body.

3. The convertible vacuum cleaner according to claim 1, wherein the hook assembly comprises:

a hook projection formed on a front surface of the support base; and a hook groove formed on a rear surface of the main body, the hook projection being inserted in the hook groove when the main body is installed on the support base.

4. The convertible vacuum cleaner according to claim 1, wherein the hook assembly controls the operation of the main body using a self-gravity of the main body.

5. The convertible vacuum cleaner according to claim 1, wherein a directional roller assembly is formed on a rear surface of the main body to guide the movement of the main body.

6. The convertible vacuum cleaner according to claim 1, wherein a top handle is formed on a top of the main body , wherein the top handle provides for coupling and decoupling of the main body with the support base.

7. The convertible vacuum cleaner according to claim 1, wherein a front handle is formed on a front surface of the main body ,wherein the front handle provides a grasping surface for movement of the main body the main body.

8. The convertible vacuum cleaner according to claim 1, wherein an installation position of the main body on the support base is fixed by the hook assembly.

9. The convertible vacuum cleaner according to claim 1, wherein a cord fixing member, around which a power cord is wound, is formed on a portion of the main body.

10. A convertible vacuum cleaner, comprising:

a support base extending in a vertical direction;

a main body selectively installed on the support base;

a pair of main body wheels provided on opposite side ends of the main body;

a power generating generator in the main body to generate an external air suction force;

a suction nozzle that draws in external air using the suction force transmitted from the main body by the power generator;

a dust collection assembly provided in the main body to filter and collect dust and dirt from the external air drawn in by the suction force;

a flexible connection hose transmitting the suction force from the main body to the suction nozzle;

a hose coupling portion to which a first end of the connection hose is coupled, the hose coupling portion being formed on the main body;

a first hook member formed on a rear surface of the main body, wherein the first hook member is provided with a first terminal; and a second hook member formed on the support base, the second hook member being engaged with the first hook member so as to support the main body on the support base, wherein the second hook member is provided with a second terminal that contacts the first terminal so as to transmit power from the main body toe the support base.

11. The convertible vacuum cleaner according to claim 10, wherein each of the first and second hook members is provided with at least one bent portion.

12. The convertible vacuum cleaner according to claim 10, wherein one of the first and second hook members is formed as a recess, and the other is formed as a projection that is selectively received in the recess.

13. The convertible vacuum cleaner according to claim 10, wherein the main body is provided with a top handle that controls engagement of the first and second hook members.

14. The convertible vacuum cleaner according to claim 10, wherein one of the first and second terminals is biased toward the other by an elastic spring.

15. The convertible vacuum cleaner according to claim 10, wherein a directional roller is formed on a rear surface of the main body and the support base is provided at a corresponding front surface thereof with a groove that receives the directional roller.

16. A convertible vacuum cleaner, comprising:

a support base provided at a top with a handle;

a main body selectively installed on the support base;

a power generator provided in the main body to generate a suction force;

a suction nozzle that draws in external air using the suction force transmitted from the main body;

a dust collection assembly provided in the main body to filter and collect dust and dirt contained in the external air drawn in by the suction force;

a flexible connection hose transmitting the suction force to the suction nozzle;

a hose coupling portion to which a first end of the connection hose is coupled, the hose coupling portion being formed on the main body;

a direction roller formed on a rear surface of the main body; and a receiving groove formed on the support base to receive the directional roller of the main body when the main body is installed on the support base.

17. A convertible vacuum cleaner, comprising:

a support base used when the vacuum cleaner is in an upright mode;

a main body selectively installed on a front surface of the support base;

a pair of main body wheels provided on opposite side ends of the main body;

a power generator provided in the main body to generate a suction force;

a suction nozzle that draws in external air using the suction force transmitted from the main body;

a dust collection assembly provided in the main body to filter and collect dust and dirt contained in the external air drawn in by the suction force;

a flexible connection hose transmitting the suction force to the suction nozzle;

a hose coupling portion to which a first end of the connection hose is coupled, the hose coupling portion being formed on the main body;

a first handle formed on a top of the main body, wherein the first handle provides for release of the main body from the support base;

a second handle formed on a front surface of the main body, wherein the second handle provides a grasping surface for movement of the main body when the vacuum cleaner is in a canister mode; and a hook assembly that supports the main body on the support base, wherein the hook assembly is provided with a pair of terminals for transmitting electric power.

* * * * *